United States Patent [19]

Giambrone

[11] Patent Number: 4,968,092

[45] Date of Patent: Nov. 6, 1990

[54] HIGH CHAIR LATCH MECHANISM

[75] Inventor: Harry J. Giambrone, Kettering, Ohio

[73] Assignee: Spalding & Evenflo Companies, Inc., Tampa, Fla.

[21] Appl. No.: 405,170

[22] Filed: Sep. 11, 1989

[51] Int. Cl.[5] ..... A47B 39/00

[52] U.S. Cl. ..... 297/151; 292/36; 297/153

[58] Field of Search ..... 297/151, 148, 149, 153, 297/154; 292/38, 36; 248/408, 424; 108/143, 147

[56] References Cited

U.S. PATENT DOCUMENTS

| | | | |
|---|---|---|---|
| 902,412 | 10/1908 | Jones | 292/36 |
| 1,983,138 | 12/1934 | Lehman | 297/149 |
| 2,118,509 | 5/1938 | Heintritz . | |
| 2,155,813 | 4/1939 | Veal | 297/151 |
| 2,505,490 | 4/1950 | Greenbaum | 297/151 |
| 3,097,884 | 7/1963 | Alford | 297/153 |
| 3,217,672 | 11/1965 | Haughy | 248/408 X |
| 3,596,952 | 8/1971 | Hinkle et al. | 292/127 X |
| 3,953,061 | 4/1976 | Hansen et al. | 292/36 X |
| 4,582,359 | 4/1986 | Wise et al. . | |
| 4,723,813 | 2/1988 | Kassai | 297/153 |
| 4,807,928 | 2/1989 | Cone | 297/151 |

*Primary Examiner*—James T. McCall

*Attorney, Agent, or Firm*—Donald R. Bahr; John E. Benoit

[57] ABSTRACT

A high chair tray latch mechanism comprising a housing secured to the underside of a high chair tray with movable latches on the opposed side of said housing for engaging apertures in the arms of the chair. A bell crank is rotatably mounted centrally within the housing between the movable latches. First and second rigid rods are pivotally attached at one end to opposite arms of the bell crank and the first and second arms are pivotally attached at their other ends to their respective latches. The crank includes a spring which rotatably biases the crank in a direction to engage the latches with the holes in the arms of the chair. A cable is connected between the crank an a lever located on the underside of the forward part of the tray. Manual squeezing of the lever relative to the tray foreshortens the cable so as to rotate the crank. Rotation of the crank overcomes the bias of the spring and the rigid rods release the latches outwardly from the holes in the arms of the high chair so that the tray may be adjusted or removed.

4 Claims, 2 Drawing Sheets

HIGH CHAIR LATCH MECHANISM present invention relates to a high chair tray latch mechanism for attachment and removal of a high chair tray. More specifically, the invention is directed to a mechanism which can be operated with one hand releasing the catches on each side of the tray from the associated arms of the high chair.

BACKGROUND OF THE INVENTION

A number of mechanisms for releasing high chair trays from their chairs have been proposed and are in use. Generally, these mechanisms are directed to the desirable feature of removing a high chair tray from a high chair with one hand, leaving the other hand free to carry the infant or child to be seated in the high chair. Most of the mechanisms designed to use only one hand to release the tray operate from the side of the tray. This obviously is disadvantageous in attempting to remove the tray, particularly if it has objects on the tray. Those trays that presently have a centrally-located front release operate by having to either push the release back or pull the release forward, which is entirely contrary to the grasping action of the human hand that is necessary to hold and remove or adjust the tray.

Accordingly, it is the object of this invention to provide a single-handed release mechanism for the tray of a high chair.

Another object of the invention is to provide a one-hand release mechanism wherein the release is actuated by a squeezing motion exemplified by the grasping of the human hand.

A further object of this invention is to provide a one-hand release mechanism for the tray of a high chair wherein the release mechanism is located centrally at the front of the tray so as to provide not only release but removal of the tray with one hand.

These and other objects of the invention will become apparent from the following description, taken together with the drawings.

SUMMARY OF THE INVENTION

This invention provides a high chair latch mechanism which includes a housing secured to the underside of the high chair tray, with the mechanism being mounted within the housing and the housing being subsequently secured to the underside of the tray. The mechanism includes latches on opposite sides of the housing for engaging apertures in the arms of the chair. A bell crank is rotatably mounted centrally within the housing between the movable latches. The bell crank includes a spring which rotatably biases the crank in a direction to engage the latches with holes in the arms of the chair. First and second rigid rods are pivotally attached to opposite arms of the bell crank and said first and second arms are pivotally connected to opposite latches. A cable is connected between the crank and a lever located on the underside of the forward part of the tray. Manual actuation of the lever by squeezing the lever against the tray pulls and foreshortens the cable by pulling it over a pin so as to rotate the crank against the bias of the spring so as to move and release the latches from the holes in the arms of the high chair so that the tray may be adjusted or removed.

The high chair latch mechanism of this invention particularly provides means for releasing the latch mechanisms while still maintaining control of the tray by locating the release lever in the middle of the tray so that with one hand the lever may be squeezed toward the tray so that the tray may be released for adjustment or removal regardless of the fact that articles may be still placed upon the tray.

DETAILED DESCRIPTION OF THE PREFERRED EMBODIMENT

Figure 1:
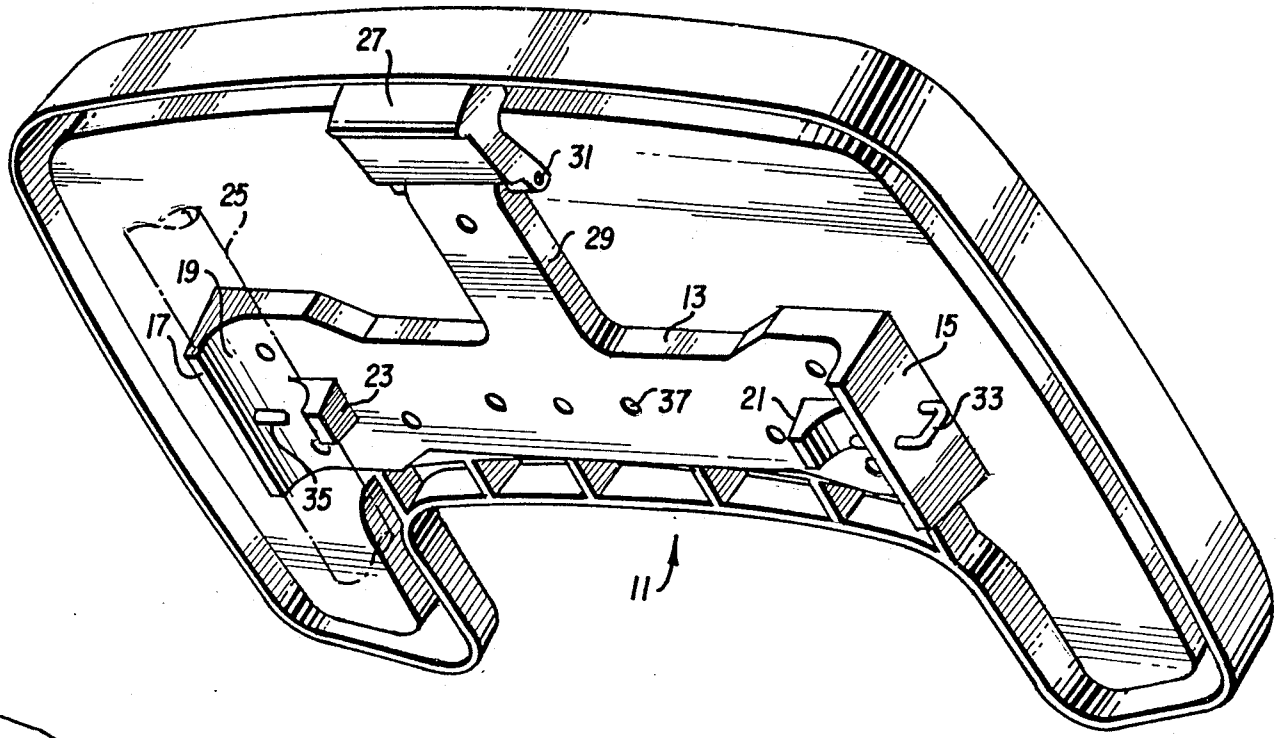
FIG. 1 is a perspective view of the housing and lever of the present, invention attached to the underside of the high chair tray.

Referring to FIG. 1, there is shown a perspective view of the underside of the tray incorporating the latch mechanism of the present invention.

Tray 11, which is a standard type tray with reinforcing structure molded beneath the tray, includes housing 13 secured to the underside of the tray. Housing 13 terminates at either end in flanges 15 and 17, which include arcuate inner surfaces 19 and a similar surface adjacent flange 15. Molded beneath housing 13 are guides 21 and 23, which also have internal arcuate surfaces. Guides 21 and 23 and flanges 15 and 17 are designed so as to encompass arms 25 of the high chair itself. One arm is disclosed in dotted lines for illustrative purposes. Leg 29 is integral with and extends from housing 13 and terminates at an end to which lever 27 is pivotally attached by means of pin 31. Also illustrated are latch pins 33 and 35, which terminate in U-shaped ends which mate with apertures or holes in the arms of the high chair so as to lock the tray in a position on the high chair.

Figure 3:
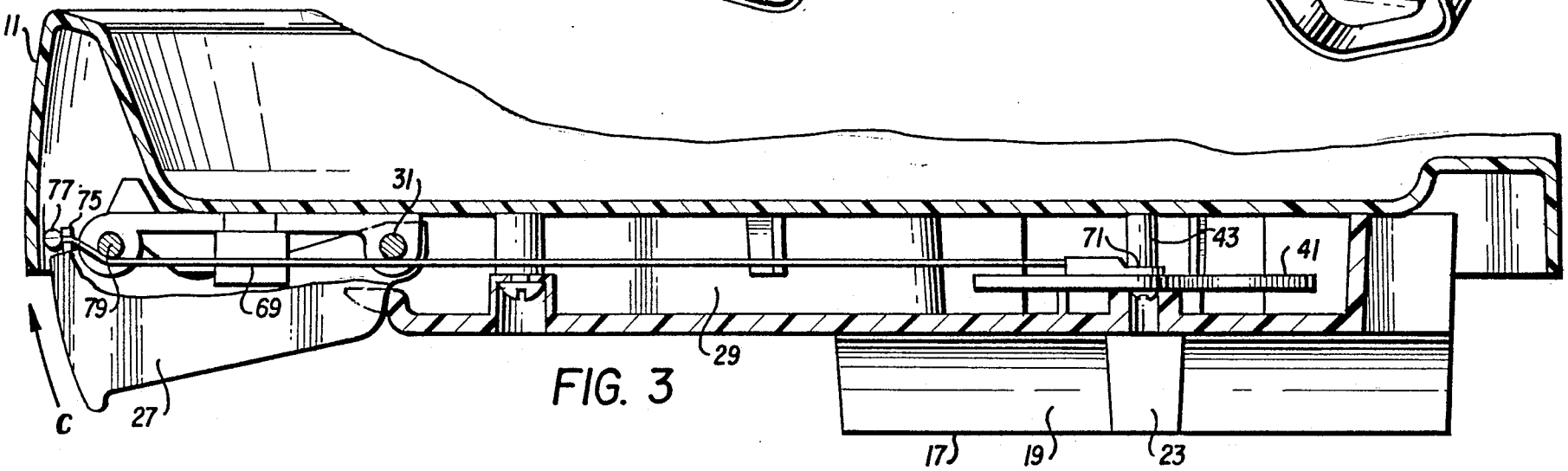
FIG. 3 is a sectional view of FIG. 2 taken through the lines 3—3 of FIG. 2.
Figure 2:
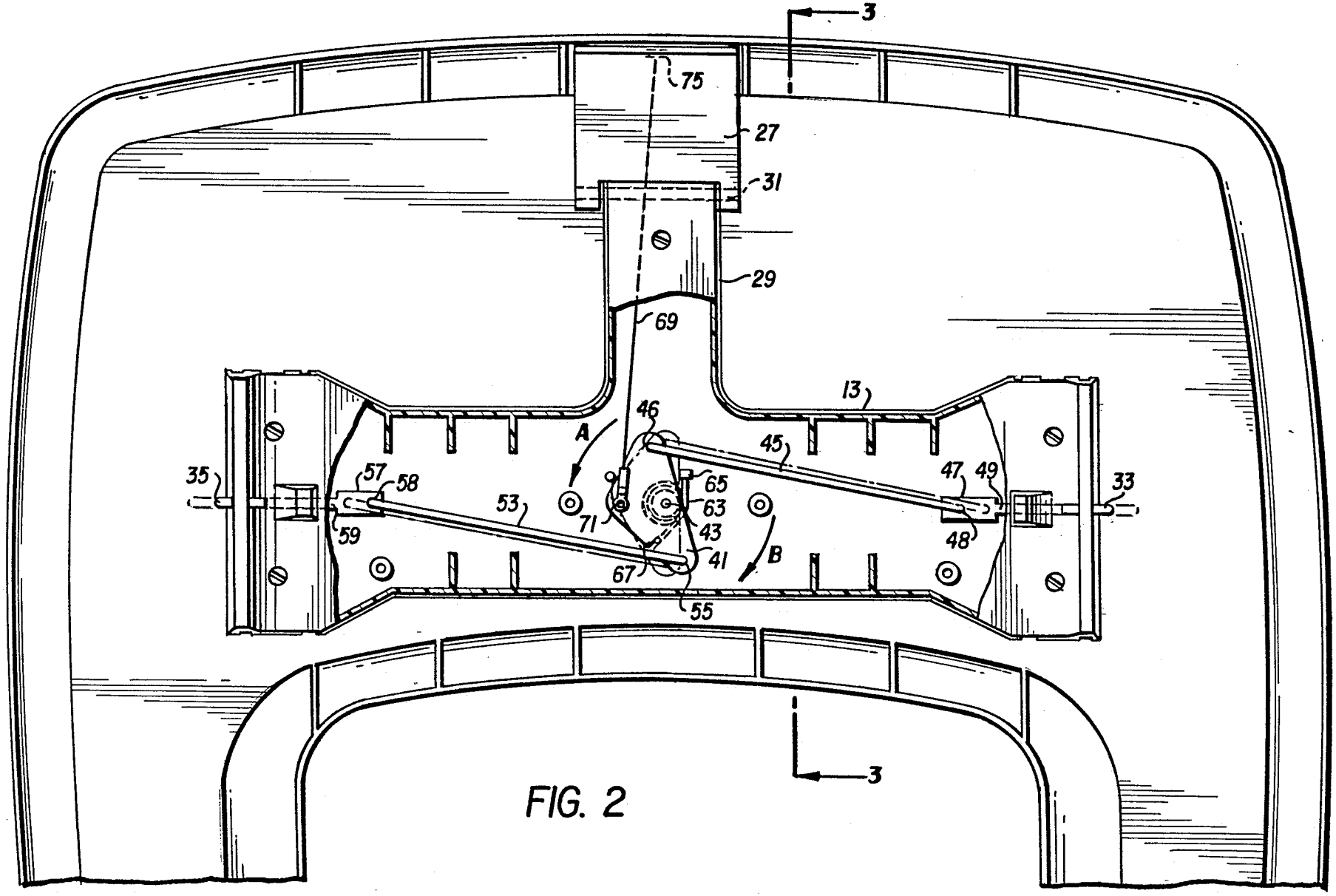
FIG. 2 is a view of the mechanism of the present invention with the bottom of the housing removed.

Referring to FIG. 2, there is shown the mechanism of the present invention which is secured to and enclosed within housing 13 of FIG. 1. For clarity purposes, the bottom of housing 13 has been removed. It is to be understood that in constructing the tray, the mechanisms are all secured within the housing and the housing is then secured to the bottom of the tray by means such as screws 37 or the like. After the housing has been secured to the tray, lever 27 is mounted on the housing for rotation by means of pin 31. Referring specifically to FIGS. 2 and 3, bell crank 41 is mounted centrally to housing 13 for rotation by means of pin 43.

Rigid rod 45 is secured to one arm of bell crank 41 by means of pin 46, which permits relative rotation between the bell crank and rod 45. Rod 45 is rotatably secured at its other end to end plate 47 of rod 49 by means such as pin 48. Plate 47 is integral with rod 49, which terminates in latch pin 33, as illustrated in FIG. 1.

In like manner, rod 53 is rotatably secured to the other arm of bell crank 41 by means of pin 55. The other end of rod 53 is secured to end plate 57, which is integral with rod 59, by means of pin 58. Rod 59 terminates in latch pin 35. Rods 49 and 59 pass through apertures in housing 13, as do the terminal ends of latch pins 33 and 35, so as to keep the rods and pins aligned during movement. In the illustration of FIG. 2, both latch pins 33 and 35 are in their locked position, wherein they have mated with the arms (not shown) of the high chair, as illustrated in the solid lines of the drawing. Rigid rods 45 and 53 are biased in this position by means of spring 63, which is secured to housing 13 at one end 65 and is secured at the other end within notch 67 of bell crank 41. This biases the bell crank in the direction as shown in arrow A.

Cable 69 is secured to the operating arm of bell crank 41 by means such as pin 71 between pins 55 and 46. This cable passes through flange 75, and ball 77 is crimped about the cable to hold it in the position shown in FIG. 3. Flange 75 is an extension of lever 27 and moves with lever 27.

Referring specifically to FIG. 3, when lever, 27 is squeezed against tray 11, flange 75 will carry cable 69 with it around pin 79, thus foreshortening the cable and rotating bell crank 41 in the direction as shown by arrow B. This moves bell crank 41 to the position shown in dotted lines in FIG. 2 and also moves associated rigid rods 45 and 53 to the position shown in dotted lines. This drives rod 43 outwardly so that latch pin 33 extends outwardly and is released from the associated arm of the chair. In like manner, latch pin 35 is also forced outwardly so as to be released from its associated arm.

As will be obvious, this squeeze action releases the tray from its locked position against the arms of the high chair. The tray can then be adjusted horizontally along the high chair so as to mate with other holes in the arms, or it can be removed from the high chair. This entire operation, including adjustment or removal, may be accomplished by a squeezing operation with one hand while holding the child in the other arm. When it is desired to place the tray back on the arms of the high chair, the operation is reversed. The person working with the tray grasps the tray and the lever in one hand, squeezes the lever so as to move the latches outwardly, slides the tray on the arms of the high chair to the position desired, releases the lever and allows the catches to engage the holes within the arms of the chair.

As will now be obvious, the present invention provides a single-handed operation for removal, adjustment, and replacement of a high chair tray on the arms of the high chair while maintaining control of the tray because of the central support of the hand on the tray. Further, the mechanism provides a simplified operation with minimal parts while obtaining the desired results.

The above description and drawings are descriptive, only, since it is obvious that equivalent components could be used without departing from the invention, the scope of which is to be limited only by the following claims.

I claim:

1. A high chair tray latch mechanism for removably securing a tray to the arms of a high chair, said latch mechanism comprising a housing secured to the underside of a high chair tray;

a bell crank rotatably mounted substantially centrally within said housing;

first and second latches mounted at opposite ends of said housing, said latches adapted to mate with apertures in the arms of a high chair;

first and second rigid bars pivotally connected between opposite arms of said bell crank and said first and second latches;

spring means for biasing said bell crank in a direction to maintain said latches in a locked position within their respective arms of said high chair;

a cable operatively connected at one end to said bell crank between said arms whereby a force exerted on said cable rotates said bell crank so as to overcome the bias of said springs and move said latches to an unlocked position relative to said high chair arms; and a lever secured to said housing and the other end of said cable whereby squeezing said lever against said tray foreshortens said cable and unlocks said latches.

2. The high chair latch mechanism of claim 1 wherein said lever is secured substantially centrally to the outer edge of said

3. A high chair latch mechanism for removably securing a tray to the arms of a high chair, said latch mechanism comprising a high chair tray;

a bell crank rotatably mounted to the underside of said tray;

first and second latch means mounted on the underside of said tray, said latch means adapted to mate with apertures in the arms of a high chair;

first and second rigid bars pivotally connected between opposite arms of said bell crank and said first and second latch means;

spring means for biasing said bell crank in a direction so as to maintain said latch means in a mated position within said apertures in said arms of said chair;

a lever rotatably mounted to the underside of the forward upper edge of said tray; and a cable operatively connected at one end to said bell crank and at the other end to said lever;

whereby manual squeezing of said lever against said forward end of said tray foreshortens said cable, rotating said bell crank against said spring bias and releasing said latches as a result of outward extension of said rods.

4. The latch mechanism of claim 3 wherein said lever is mounted substantially centrally under said forward upper edge of said tray.

* * * * *